US005662366A

United States Patent [19]

Fraske

[11] Patent Number: 5,662,366

[45] Date of Patent: Sep. 2, 1997

[54] GOLF BALL RETRIEVER

[76] Inventor: Arthur Edward Fraske, P.O. Box 13, Plover, Wis. 54467

[21] Appl. No.: 711,944

[22] Filed: Sep. 4, 1996

Related U.S. Application Data

[60] Provisional application No. 60/020,426 Jun. 25, 1996.

[51] Int. Cl.[6] ..... A63B 47/02

[52] U.S. Cl. ..... 294/19.2

[58] Field of Search ..... 294/19.2, 55, 55.5, 294/66.1; 37/316; 56/400.01, 400.04, 400.11, 400.19, 400.21

[56] References Cited

U.S. PATENT DOCUMENTS

| | | | |
|---|---|---|---|
| D. 206,076 | 10/1966 | Lehman | 294/19.2 X |
| 1,141,423 | 6/1915 | Simas | 294/19.2 X |
| 2,738,214 | 3/1956 | Zimmers . | |
| 3,210,111 | 10/1965 | Fallon | 294/19.2 |
| 3,442,544 | 5/1969 | Faber | 294/19.2 |
| 3,717,371 | 2/1973 | Halone | 294/19.2 |
| 4,254,981 | 3/1981 | Wilson . | |
| 4,289,344 | 9/1981 | Mitchell | 294/19.2 X |
| 4,411,463 | 10/1983 | Alderman | 294/19.2 |
| 4,635,987 | 1/1987 | Hurtgam . | |
| 4,828,690 | 5/1989 | Montez . | |
| 4,974,894 | 12/1990 | Dubow | 294/19.2 |
| 5,110,168 | 5/1992 | Petrillo . | |
| 5,246,260 | 9/1993 | Racicot . | |
| 5,482,338 | 1/1996 | Hall . | |

*Primary Examiner*—Johnny D. Cherry
*Attorney, Agent, or Firm*—Richard C. Litman

[57] ABSTRACT

A device for retrieving golf balls from water hazards, which includes a main body resembling a scoop with a handle holder to which a pole-like handle may be attached. The main body has two parallel oppositely positioned end walls, and preferably three slots that can retain golf balls while allowing water to pass through as the invention is moved along the bottom of a water hazard to retrieve the balls. Rounded end portions of the slots are shaped so that the balls will tend to fall into them, rather than rolling back out of the interior of the main body. In the preferred embodiment, two center strips run between slots. Two end strips run between slots and the end walls to which they are connected. The strips and end walls are joined by a top cross strip and a bottom cross strip. The handle holder includes preferably a widened portion of the top cross strip, to which are perpendicularly joined two parallel upright members, between which preferably two parallel bolts are inserted, to hold the handle in place.

5 Claims, 2 Drawing Sheets

GOLF BALL RETRIEVER

CROSS REFERENCE TO RELATED APPLICATION

This application is based on Provisional Patent Application Serial No. 60/020,426, filed on Jun. 25, 1996, now abandoned.

BACKGROUND OF THE INVENTION

1. Field of the Invention

The present invention relates to a device for retrieving golf balls from bodies of water.

2. Description of the Prior Art

Although there are patents for golf ball retrievers in the prior art, none are equivalent to the present invention, which is a slotted scoop that may be detachably retained on an elongated handle. The slots have rounded bottom ends, so as to better retain balls being retrieved. This structure makes it more likely that balls, of which retrieval is attempted, will be securely retained in the scoop, while water can pass through the slots.

U.S. Pat. No. 2,738,214, issued on Mar. 13, 1956, to Mildred G. Zimmers, discloses a golf ball retriever, having a plurality of "fingers" which grasp the ball like a rake. The slots in the instant invention are distinguishable from the spaces between the fingers in Zimmers, as there are no cross members connecting the fingers in Zimmers.

U.S. Pat. No. 4,254,981, issued on Mar. 10, 1981, to Albert C. Wilson, discloses a golf ball retriever, having an elongated handle with a flat plate at one end, with a plurality of retrieving fingers pivotally attached to the plate, with a sliding bar controlling the distance between the fingers. The instant invention is distinguishable in having a scoop with slots in a fixed position.

U.S. Pat. No. 4,635,987, issued on Jan. 13, 1987, to Mervin W. Hurtgam, discloses a golf ball retrieving device, with curved tines perpendicularly connected to upper and lower straight stabilizing members, and a detachable elongated handle. The instant invention is distinguishable, in having a scoop with slots having rounded bottom ends to retain golf balls being retrieved.

U.S. Pat. No. 4,828,690, issued on May 9, 1989, to Obed Montez, discloses a hand tool for sifting debris from sand and soil, having a tapered wedge head and an entrapment mesh. It is distinguishable from the instant invention, in that although the mesh may resemble a scoop, it does not have slots, and the slots in the wedge head are straight rather than curved.

U.S. Pat. No. 5,110,168, issued on May 5, 1992, to John Petrillo, discloses a golf ball retriever, having a frame attachable to an elongated handle, but without a scoop having slots with rounded ends, as in the instant invention.

U.S. Pat. No. 5,246,260, issued on Sep. 21, 1993, to Conrad Racicot, discloses a retriever for golf balls in water hazards, with rake-like tines that are distinguishable from the flat portions between the slots in the scoop of the instant invention.

U.S. Pat. No. 5,482,338, issued on Jan. 9, 1996, to Norman E. Hall, discloses a golf ball retriever, with an array of rigid curved fingers, as distinguished from the slotted scoop of the instant invention.

None of the above inventions and patents, taken either singly or in combination, is seen to describe the instant invention as claimed.

SUMMARY OF THE INVENTION

The present invention is a tool for retrieving golf balls from water hazards, being a scoop with slots that allow water to pass through, while retaining golf balls. The slots have rounded ends to better retain the golf balls. The invention can be removably attached to an elongated handle.

Accordingly, it is a principal object of the invention to provide a new and improved means for retrieving golf balls from water hazards.

It is another object of the invention to provide a slotted scoop for retrieving golf balls, that can be removably fastened to an elongated handle.

It is a further object of the invention to provide a means for retrieving small round objects.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
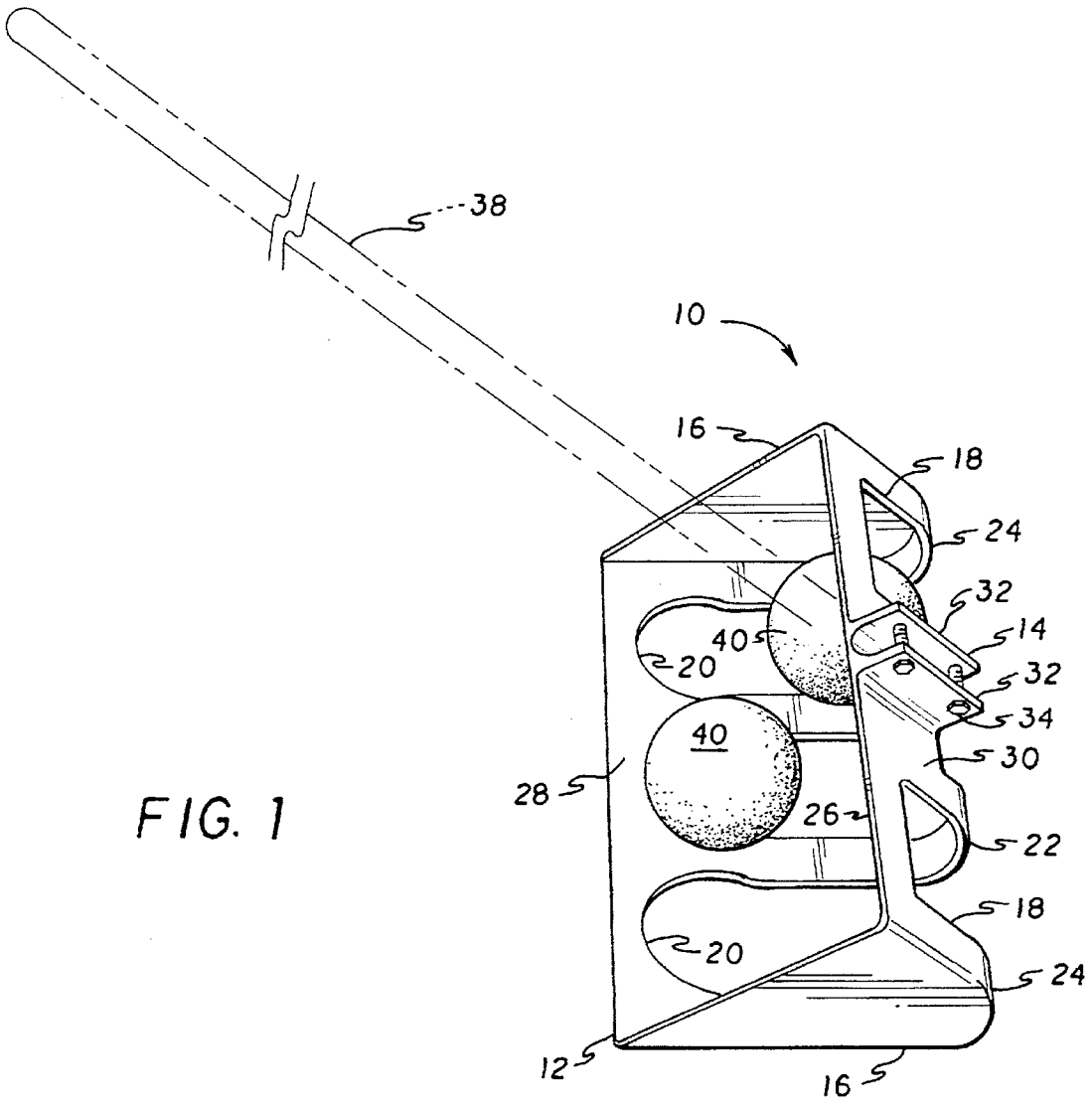
FIG. 1 is perspective view of the invention, showing golf balls in the retriever, and the pole used as a handle in broken lines.

The present invention is a device for retrieving golf balls from water hazards. FIG. 1 is perspective view of the invention which includes an elongated scoop 10 of unitary construction having a flat bottom portion 28 arcuately connected to a flat top portion 27. Flat bottom portion 28 has a leading edge 12 extending along the length thereof and flat top portion 30 has top edge 26 extending along its length. Scoop 10 has two parallel oppositely positioned end walls 16, and three slots 18 that can retain golf balls 40 (which are not part of the claimed invention) while allowing water to pass through as the invention is moved along the bottom of a water hazard to retrieve the balls. Rounded or arcuate end portions 20 of the slots are slightly larger in diameter than the width of the other portions of the slots, and are shaped so that the balls will tend to fall into them, rather than rolling back out of the interior of the main body. This is accomplished by the rounded or arcuate end portion 20 capturing and seating the golf balls 40 therein. Two center strips 22 run between slots. Two end strips 24 run between slots and the end walls to which they are connected. The handle holder 14 is centrally disposed on flat top portion 30 to which are perpendicularly joined two parallel members 32, between which two parallel bolts 34 are inserted, to hold the handle 38 shown in broken lines) in place.

Figure 2:
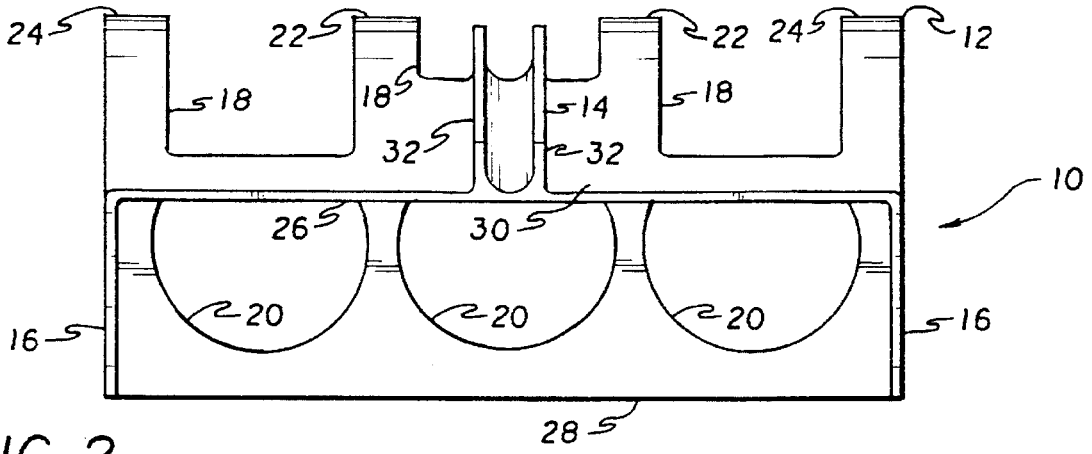
FIG. 2 is a front elevational view of the invention.
Figure 3:
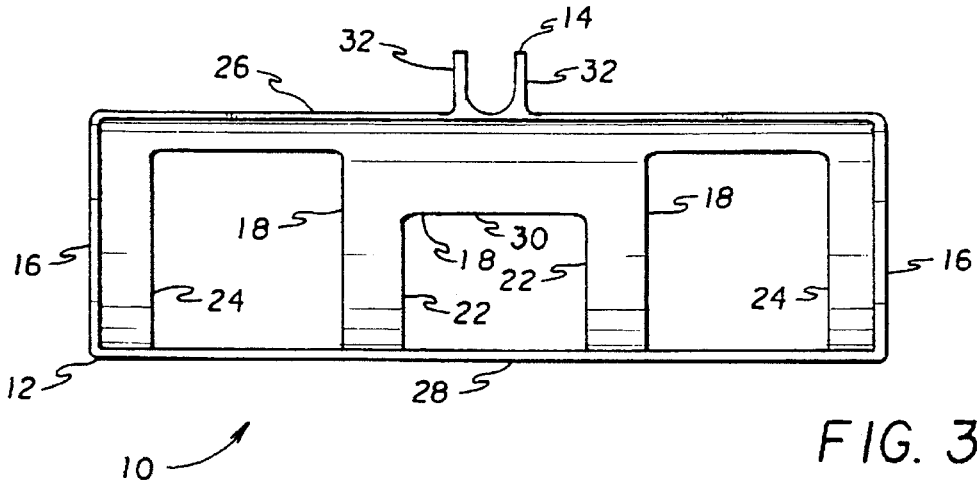
FIG. 3 is a rear elevational view of the invention.
Figure 4:
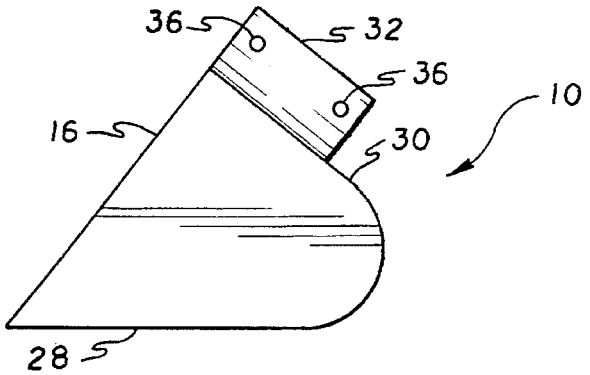
FIG. 4 is right side elevational view of the invention.

FIG. 2 is a front elevational view of the invention. FIG. 3 is a rear elevational view of the invention. FIG. 4 is right side elevational view of the invention, showing the holes 36 in the parallel members 32 through which the bolts pass. The corner's where the strips or members join at right angles are rounded for extra strength, and to reduce the probability of splits in the material that the invention is made of starting in square corners. As best shown in FIG. 4, the flat top portion 30 is positioned at an acute angle with respect to the flat bottom portion 28.

The scoop 10 including and handle holder 14 are preferably made of a plastic that is rigid enough to retain its shape, but flexible enough to avoid breaking. The handle is preferably made of aluminum.

Alternatively, the number of slots may be more or less than three, in which case the sum of the number of end and center strips will be one more than the number of slots. There may also be a different number of holes for bolts in the handle holder.

It is to be understood that the present invention is not limited to the sole embodiment described above, but encompasses any and all embodiments within the scope of the following claims.

I claim:

1. A golf ball retrieval device comprising:

an elongated scoop of unitary construction having a flat bottom portion arcuately connected to a flat top portion, and two flat oppositely positioned parallel end walls;

said flat bottom portion having a leading edge along the length thereof;

said flat top portion having a top edge and a U-shaped channel for coupling an elongated handle; and a plurality of parallel slots extending from adjacent said leading edge to adjacent said top edge, each said slot having a width and an arcuate end adjacent said leading edge of said flat bottom portion;

said arcuate end having a diameter greater than said width of said slot for capturing and seating a golf ball in said scoop.

2. The device according to claim 1, wherein the scoop and handle channel are made of plastic.

3. The device according to claim 1, said U-shaped channel further including means for clamping, whereby an elongated handle is removably secured within said U-shaped channel.

4. The device according to claim 1, said flat top portion and said bottom portion are disposed at an acute angle, wherein the arcuate connection is defined within said acute angle.

5. The device according to claim 1, wherein the number of slots is at least three.

* * * * *